US012213529B2

(12) United States Patent
Sayed et al.

(10) Patent No.: US 12,213,529 B2
(45) Date of Patent: Feb. 4, 2025

(54) AEROSOL PROVISION DEVICE

(71) Applicant: NICOVENTURES TRADING LIMITED, London (GB)

(72) Inventors: Ashley John Sayed, London (GB); Luke James Warren, London (GB); Thomas Alexander John Woodman, London (GB)

(73) Assignee: NICOVENTURES TRADING LIMITED, London (GB)

( * ) Notice: Subject to any disclaimer, the term of this patent is extended or adjusted under 35 U.S.C. 154(b) by 557 days.

(21) Appl. No.: 17/438,016

(22) PCT Filed: Mar. 9, 2020

(86) PCT No.: PCT/EP2020/056230
§ 371 (c)(1),
(2) Date: Sep. 10, 2021

(87) PCT Pub. No.: WO2020/182740
PCT Pub. Date: Sep. 17, 2020

(65) Prior Publication Data

US 2022/0142253 A1 May 12, 2022

(30) Foreign Application Priority Data

Mar. 11, 2019 (GB) ..... 1903243

(51) Int. Cl.
*A24F 40/465* (2020.01)
*A24F 40/20* (2020.01)
*A24F 40/42* (2020.01)

(52) U.S. Cl.
CPC ..... *A24F 40/465* (2020.01); *A24F 40/20* (2020.01); *A24F 40/42* (2020.01)

(58) Field of Classification Search
CPC ..... A24F 40/465; A24F 40/20; A24F 40/42; A24F 40/40; A24F 40/85; A24D 1/20
(Continued)

(56) References Cited

U.S. PATENT DOCUMENTS 9,966,692 B2 5/2018 Yamachika et al.
2012/0305009 A1* 12/2012 Morgan ..... A24F 1/28 131/191

(Continued)

FOREIGN PATENT DOCUMENTS

CN 203659946 U 6/2014
CN 205456047 U 8/2016

(Continued)

OTHER PUBLICATIONS

"International Preliminary Report on Patentability received for PCT Patent Application No. PCT/EP2020/056230, mailed on Sep. 23, 2021", 8 pages.

(Continued)

*Primary Examiner* — Alexander Gilman
(74) *Attorney, Agent, or Firm* — Husch Blackwell

(57) ABSTRACT

An aerosol provision device is provided. The device has an axis and comprises, at a first end, an end member at least partially surrounded by an outer cover. The end member and the outer cover together define an end surface of the aerosol provision device, wherein the end member defines a recess which is positioned away from the end surface in the direction of the axis and is covered by the outer cover.

16 Claims, 9 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2015/0216236 | A1* | 8/2015 | Bless | B23K 26/20 131/328 |
| 2017/0202267 | A1* | 7/2017 | Liu | A24F 40/42 |
| 2017/0208865 | A1* | 7/2017 | Nettenstrom | B65D 43/163 |
| 2018/0007962 | A1* | 1/2018 | Hunt | A61M 15/0021 |
| 2019/0046745 | A1* | 2/2019 | Nettenstrom | A61M 11/042 |
| 2019/0313695 | A1* | 10/2019 | Kaufman | H05B 6/365 |
| 2019/0364973 | A1* | 12/2019 | Kaufman | A24F 40/465 |

FOREIGN PATENT DOCUMENTS

| | | | |
|---|---|---|---|
| CN | 106235419 | A | 12/2016 |
| CN | 106690425 | A | 5/2017 |
| CN | 109043669 | A | 12/2018 |
| JP | 2012182200 | A | 9/2012 |
| WO | 2013/089551 | A1 | 6/2013 |
| WO | 2017068099 | A1 | 4/2017 |
| WO | 2018/100461 | A1 | 6/2018 |
| WO | 2019/030364 | A1 | 2/2019 |

OTHER PUBLICATIONS

International Search Report and Written Opinion issued in PCT/EP2020/056230, dated May 11, 2020, 14 pgs.

* cited by examiner

AEROSOL PROVISION DEVICE

PRIORITY CLAIM

The present application is a National Phase entry of PCT Application No. PCT/EP2020/056230, filed Mar. 9, 2020, which claims priority from GB Application No. 1903243.2, filed Mar. 11, 2019, which is hereby fully incorporated herein by reference.

TECHNICAL FIELD

The present disclosure relates to an aerosol provision device, and a method for protecting electrical components of an aerosol provision device from water ingress.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of the present disclosure, there is provided an aerosol provision device, the aerosol provision device having an axis and comprising, at a first end, an end member at least partially surrounded by an outer cover, the end member and the outer cover together defining an end surface of the aerosol provision device, wherein the end member defines a recess which is positioned away from the end surface in the direction of the axis and is covered by the outer cover.

According to a second aspect of the present disclosure, there is provided a method for protecting electrical components of an aerosol provision device from water ingress, the method comprising:

positioning the electrical components for protection in a portion of the device spaced apart from an end of the device;

providing an air gap between otherwise generally abutting surfaces, wherein the air gap is positioned between the end of the device and the electrical components, the air gap preventing flow of water by capillary action from the end of the device to the electrical components.

Further features and advantages of the disclosure will become apparent from the following description of embodiments of the disclosure, given by way of example only, which is made with reference to the accompanying drawings.

DETAILED DESCRIPTION

Figure 1:
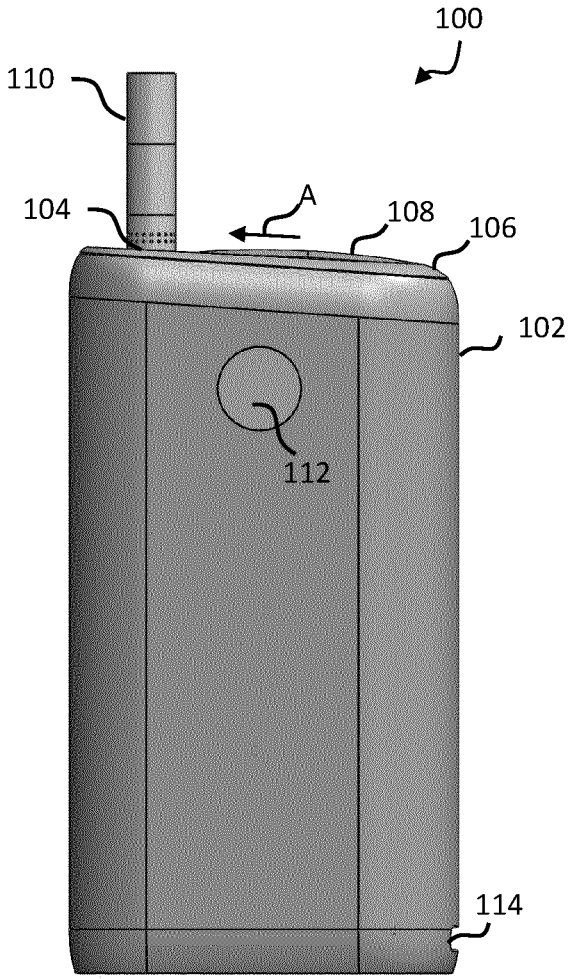
FIG. 1 shows a front view of an example of an aerosol provision device.

As used herein, the term "aerosol generating material" includes materials that provide volatized components upon heating, typically in the form of an aerosol. Aerosol generating material includes any tobacco-containing material and may, for example, include one or more of tobacco, tobacco derivatives, expanded tobacco, reconstituted tobacco or tobacco substitutes. Aerosol generating material also may include other, non-tobacco, products, which, depending on the product, may or may not contain nicotine. Aerosol generating material may for example be in the form of a solid, a liquid, a gel, a wax or the like. Aerosol generating material may for example also be a combination or a blend of materials. Aerosol generating material may also be known as "smokable material".

Apparatus are known that heat aerosol generating material to volatize at least one component of the aerosol generating material, typically to form an aerosol which can be inhaled, without burning or combusting the aerosol generating material. Such an apparatus is sometimes described as an "aerosol generating device", an "aerosol provision device", a "heat-not-burn device", a "tobacco heating product device" or a "tobacco heating device" or similar. Similarly, there are also so-called e-cigarette devices, which typically vaporize an aerosol generating material in the form of a liquid, which may or may not contain nicotine. The aerosol generating material may be in the form of or be provided as part of a rod, cartridge or cassette or the like which can be inserted into the apparatus. A heater for heating and volatizing the aerosol generating material may be provided as a "permanent" part of the apparatus.

An aerosol provision device can receive an article comprising aerosol generating material for heating. An "article" in this context is a component that includes or contains in use the aerosol generating material, which is heated to volatize the aerosol generating material, and optionally other components in use. A user may insert the article into the aerosol provision device before it is heated to produce an aerosol, which the user subsequently inhales. The article may be, for example, of a predetermined or specific size that is configured to be placed within a heating chamber of the device which is sized to receive the article.

A first aspect of the present disclosure defines an aerosol provision device with an end member located towards one end of the device. The end member is at least partially covered by an outer cover, which can surround the device. The end member, and an edge of the outer cover, together define at least part of an end surface of the device. It has been found that water, or other liquids, may enter the body of the device by capillary action. For example, water may flow into the device through a small gap between the end member and the outer cover. This water can travel into the device, between an inner surface of the cover and a side surface of the end member, which can cause damage to, or cause problems with, components of the device.

To reduce such water ingress by capillary action, the end member is provided with a recess, such as a groove or channel, which limits or reduces the flow of water into the device. The recess may be formed away from the end surface of the device, in a surface of the end member which may come into contact with water (such as a side surface of the end member). The recess is therefore located beneath the outer cover. The recess interrupts the capillary flow of water so that water is less likely to flow beyond the recess. The recess provides a larger gap or distance between the end member and the inner surface of the outer cover which reduces the ability for the water to flow further into the device under capillary action. The recess therefore acts as a barrier and protects the device from water ingress. Components positioned further away from the end surface than the recess are protected by the recess from water ingress by capillary action.

The device defines an axis, such as longitudinal axis, and the recess may extend at least partially around the longitudinal axis (i.e. may extend at least partially around the side surface of the end member which is covered by the outer cover). In some devices the recess extends fully around the longitudinal axis to provide a continuous recess. The outer cover may also extend fully around the longitudinal axis, and therefore cover the continuous recess. In devices where the recess extends substantially around the longitudinal axis, improved protection from water ingress is provided because the recess stops water ingress at all points around the device.

The recess may extend around the end member in a direction which is substantially perpendicular to the longitudinal axis of the device. However, in other arrangements, only some portions of the recess extend around the end member in a direction which is substantially perpendicular to the longitudinal axis of the device. Other portions of the recess may extend around the end member in a direction that is angled with respect to the substantially perpendicular portions of the recess.

The end member may comprise a bottom surface which forms a portion of the end surface of the device. The end member may also comprise at least one side surface extending away from the bottom surface. The at least one side surface may be covered by the outer cover. The recess can be formed along the at least one side surface. The side surfaces may extend away from the bottom surface in a direction parallel to the longitudinal axis.

As mentioned, the end member and an edge of the outer cover together define at least part of an end surface of the device. For example, the bottom surface of the end member and the bottom edge of the outer cover may define at least part of an end surface of the device. The bottom edge and bottom surface may not be flush with each other. For example, the bottom edge of the outer cover may extend further along the longitudinal axis than the bottom surface of the end member (or vice-versa).

The device may comprise an electrical component positioned further away from the end surface than the recess. For example, the electrical component may be located on the other side of the recess from the end surface. Hence the electrical component is positioned away from the end surface (in a direction parallel to the longitudinal axis) by a distance that is greater than that of the recess. Accordingly, the recess can protect the electrical component from water damage by stopping the water from reaching the electrical component. The electrical component may be positioned within a portion of the end member. For example, the end member may define a receptacle within which the component can be received. In an example where the recess extends substantially around the end member, only a portion of the recess need be positioned between the electrical component and end surface to provide protection to the electrical component.

The electrical component may be a component of an interface, such as a socket/port. In one particular example, the electrical component is a female USB connector.

In one example, the electrical component is a socket and the end member delimits a through hole for access to the socket. For example, an interface or plug, such as a charging cable, may pass through the through hole formed in a side surface of the end member to engage the socket. The through hole is arranged further away from the end surface than the recess and so the recess stops water from flowing into the socket and/or the rest of the device. The outer cover may also delimit a corresponding through hole to the through hole of the end member. The through hole may be formed in a direction generally perpendicular to the longitudinal axis of the device.

The end member may comprise a second recess extending around the longitudinal axis, and the device may comprise a resilient member arranged in the second recess. For example, the resilient member may be an O-ring which sits within the second recess. The resilient member and second recess provide further protection from water ingress by acting as a seal. The resilient member may abut the inner surface of the outer cover and therefore act as a barrier. The second recess may therefore also be covered by the outer cover.

The second recess may be arranged further away from the end surface than the (first) recess. Thus, the second recess and resilient member acts as a second barrier to protect from water ingress. For example, the resilient member may abut the outer cover to form a seal. The second recess may be arranged further away from the end surface because water may become trapped in the second recess, under the resilient member, so it may be desirable to reduce the amount of water reaching the second resilient member.

The second recess may lie in a plane perpendicular to the longitudinal axis.

The end member may comprise an attachment component arranged further away from the end surface than the recess. The attachment component is configured to engage the outer cover, and therefore hold the outer cover in place. By positioning the attachment component further away from the end surface than the recess, the likelihood of water coming into contact with the attachment component is reduced. The water may, for example, cause the attachment component to become damaged, corroded, rusted, or otherwise become less effective, for example by reducing a resistance to movement between the attachment element and the outer cover, such as by acting as a lubricant.

The attachment component may also be arranged further away from the end surface than the second recess to further reduce the likelihood of contact with water.

The end member may delimit a further through hole through which the attachment component protrudes. This can help reduce the overall profile of the apparatus because the attachment component, which may be relatively large or bulky can be arranged primarily inside the end member.

The attachment component may be a spring or magnet for example. A spring may protrude into a corresponding recess formed on an inner surface of the outer cover.

The end member may comprise one or more further attachment components arranged around the end member.

The recess may have a depth dimension of greater than about 0.3 mm, greater than about 0.5 mm, greater than about 1 mm, or greater than about 2 mm. The recess may have a depth dimension of less than about 5 mm, less than about 4 mm, or less than about 3 mm. In one example, the recess may have a depth dimension of about 0.5 mm. The depth dimension is a distance measured in a direction perpendicular to the longitudinal axis of the device. Recesses with depths within this range have been found to be effective at reducing the capillary flow of water. In general, the deeper the recess the more effective it is at blocking capillary action. If the recess needs to be deeper, the end member must be made larger to allow the increased depth, which increases the overall size of the device, these depths have been found to present a good balance between size and effectiveness.

In some examples, the recess is formed through a wall (such as the side surface) of the end member. The recess may not extend through the wall by more than about 60% of the wall thickness. This ensures that the structural integrity of the wall is not compromised by forming a recess in the wall.

The recess may have a width dimension of greater than about 0.5 mm, greater than about 0.8 mm, greater than about 0.9 mm, greater than about 1 mm, greater than about 2 mm, or greater than about 4 mm. The recess may have a width dimension of less than about 10 mm, less than about 8 mm, less than about 6 mm, less than about 4 mm, less than about 2 mm, or less than about 1 mm. In one example, the recess may have a width dimension of between about 0.7 mm and about 1.5 mm. In another example, the recess may have a width dimension of about 0.9 mm. The width dimension is a distance measured in a direction parallel to the longitudinal axis of the device. Recesses with widths within this range are effective at reducing the capillary flow of water into the device. This is because capillary action is a function not just of the gap between surfaces but gravity, when a device is oriented vertically, water can only flow to a certain height under capillary action. There is therefore a balance between the width dimension and effectiveness, with longer width dimensions being more effective but this also impacts the size of the device. This also interacts with the depth dimension, because a deeper narrower recess many provide similar protection to a shallower wider recess.

At least a portion of the recess may be positioned away from the end surface by a distance of about 0.5 mm to about 15 mm. In one example, at least a portion of the recess may be positioned away from the end surface by a distance of about 0.5 mm to about 10 mm. In another example, at least a portion of the recess may be positioned away from the end surface by a distance of about 0.5 mm to about 1.5 mm. In another example, at least a portion of the recess may be positioned away from the end surface by a distance of about 0.7 mm to about 1 mm. In another example, at least a portion of the recess may be positioned away from the end surface by a distance of about 0.8 mm. If the recess is positioned closer to the end surface, the volume of water reaching the recess is likely to be higher than if the recess is positioned further away (because a volume of water will be retained in the capillary formed between the end member and the cover). It may therefore be more effective to position the recess further away, but this increases the overall size of the device or places design constraints on the position of components to protect against water ingress. These distances provide an effective balance of these considerations.

The "portion of the recess" is the portion of the recess arranged closest to the end surface. Accordingly, if the whole recess is arranged in a plane perpendicular to the longitudinal axis, then the whole recess is positioned at an equal distance from the end surface. However, if portions of the recess are positioned at different distances from the end surface (measured in a direction parallel to the longitudinal axis), then the "portion of the recess" refers to the portion arranged closest to the end surface.

In a second aspect of the present disclosure there is provided a method for protecting electrical components of an aerosol provision device from water ingress. The method comprises:

(i) positioning the electrical components for protection in a portion of the device spaced apart from an end of the device; and (ii) providing an air gap between otherwise generally abutting surfaces, wherein the air gap is positioned between the end of the device and the electrical components, the air gap preventing flow of water by capillary action from the end of the device to the electrical components.

The air gap may be provided between the outer cover and the end member of the device, for example. As mentioned above, the outer cover generally abuts the side surface of the end member. The water flows, via capillary action, between these two abutting surfaces until it reaches the air gap. The air gap therefore protects the electrical components from the water.

The air gap may be provided by forming a recess, such as a groove or channel on one, or both, of the generally abutting surfaces. Providing the air gap may comprise forming a recess on a surface of an end member of the device. The recess may be formed by molding the end member to include a recess. Alternatively, the recess may be formed by removing material from the end member after it is manufactured.

Providing an air gap may comprise providing an air gap with the dimensions described above for the recess.

Positioning the electrical components for protection in a portion of the device may comprise:

forming a through hole in a surface of the end member at a position further away from the end surface than the air gap; and positioning the electrical components adjacent to the through hole.

After providing an air gap by forming a recess, the method may further comprise forming a second recess on the surface of the end member and arranging a resilient member within the second recess.

The method may further comprise:

arranging an attachment component at a position further away from the end surface than the recess; and attaching an outer cover to the end member via the attachment component, thereby to cover the recess.

FIG. 1 shows an example of an aerosol provision device 100 for generating aerosol from an aerosol generating medium/material. In broad outline, the device 100 may be used to heat a replaceable article 110 comprising the aerosol generating medium, to generate an aerosol or other inhalable medium which is inhaled by a user of the device 100.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 1, the lid 108 is shown in an open configuration, however the cap 108 may move into a closed configuration. For example, a user may cause the lid 108 to slide in the direction of arrow "A".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port. In some examples the socket 114 may be used additionally or alternatively to transfer data between the device 100 and another device, such as a computing device.

Figure 2:
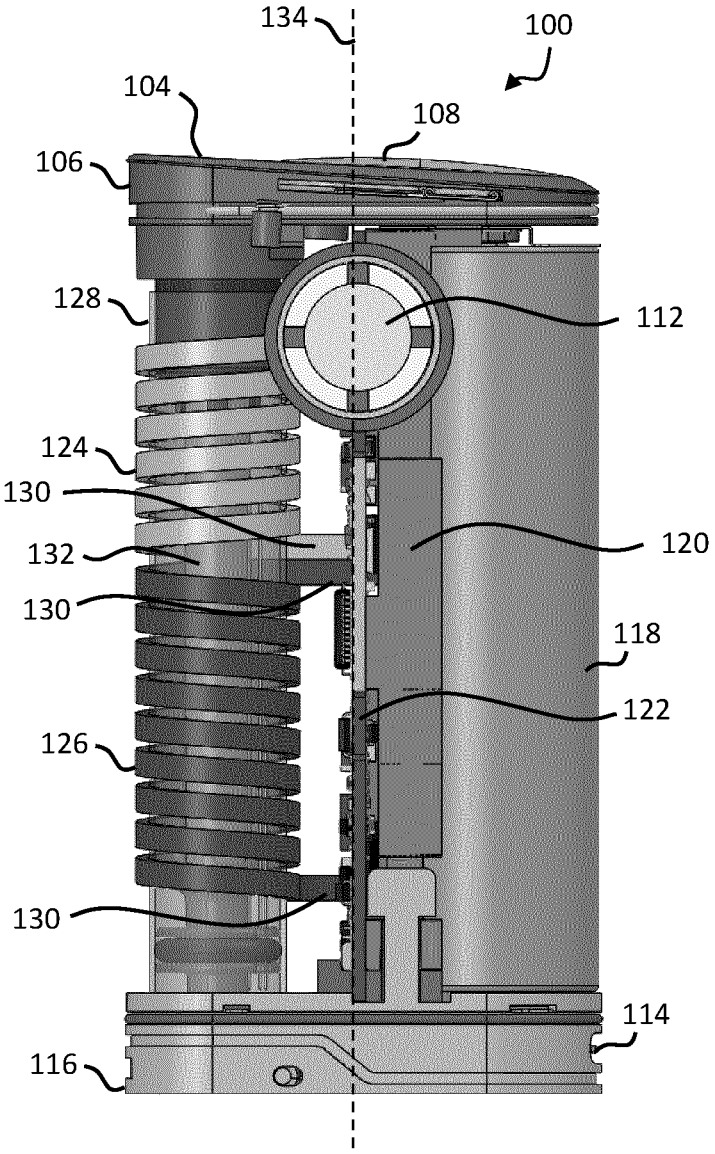
FIG. 2 shows a front view of the aerosol provision device of FIG. 1 with an outer cover removed.

FIG. 2 depicts the device 100 of FIG. 1 with the outer cover 102 removed and without an article 110 present. The device 100 defines a longitudinal axis 134.

As shown in FIG. 2, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e., by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 do not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 2, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material than the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section of the article 110, and at a later time, the second inductor coil 126 may be operating to heat a second section of the article 110. Winding the coils in opposite directions helps reduce the current induced in the inactive coil when used in conjunction with a particular type of control circuit. In FIG. 2, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The device 100 of FIG. 2 further comprises an insulating member 128 which may be generally tubular and at least partially surround the susceptor 132. The insulating member 128 may be constructed from any insulating material, such as plastic for example. In this example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 2, the first and second inductor coils 124, 126 are positioned around the insulating member 128 and are in contact with a radially outward surface of the insulating member 128. In some examples the insulating member 128 does not about the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 3:
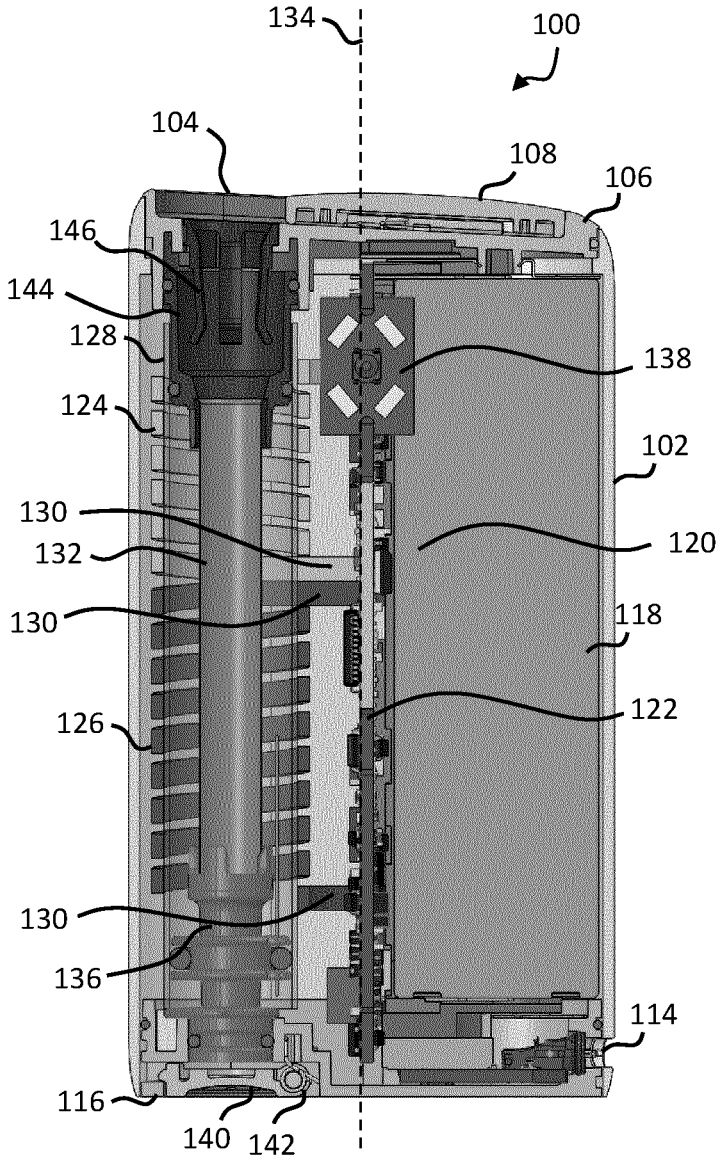
FIG. 3 shows a cross-sectional view of the aerosol provision device of FIG. 1.

FIG. 3 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 4:
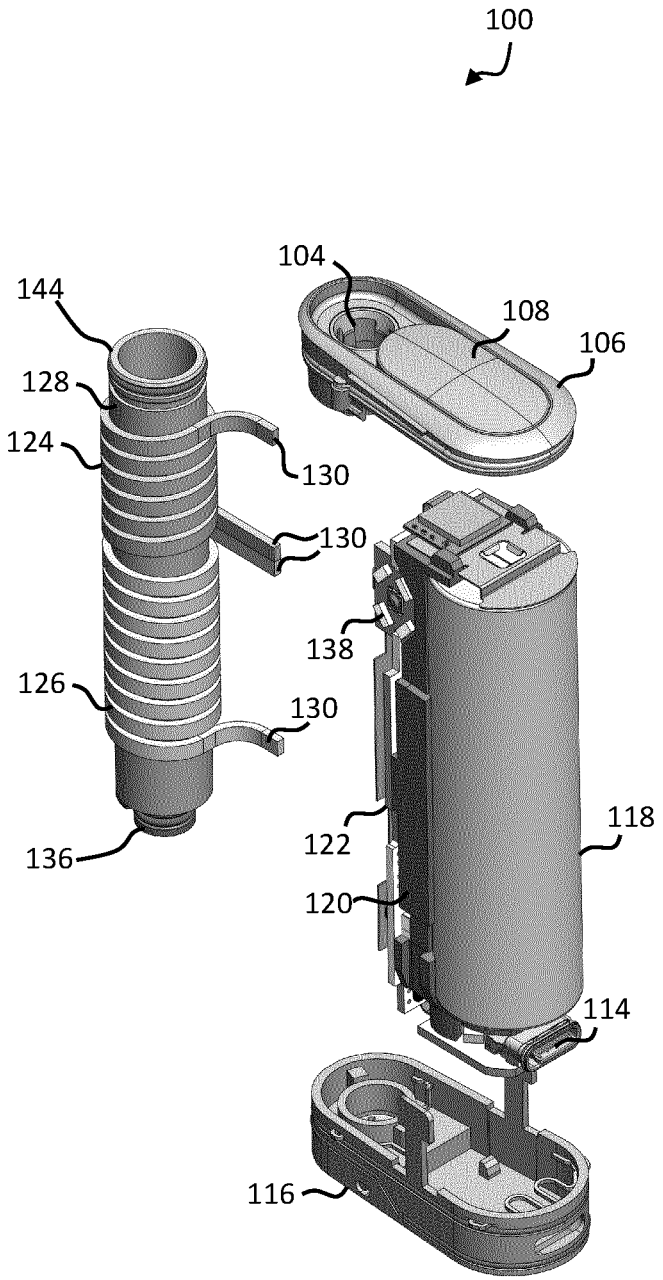
FIG. 4 shows an exploded view of the aerosol provision device of FIG. 2.

FIG. 4 is an exploded view of the device 100 of FIG. 1, with the outer cover 102 omitted.

Figure 5A:
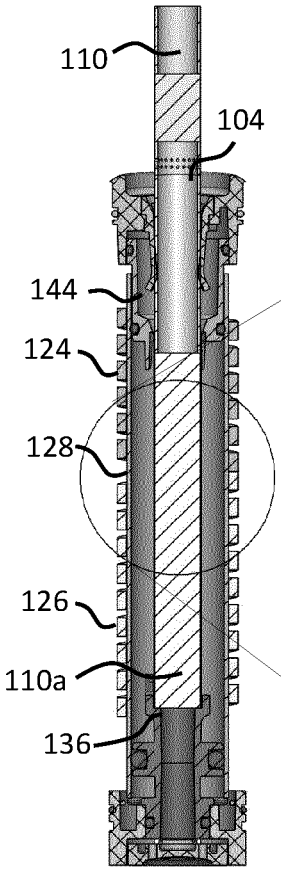
FIG. 5A shows a cross-sectional view of a heating assembly within an aerosol provision device.
Figure 5B:
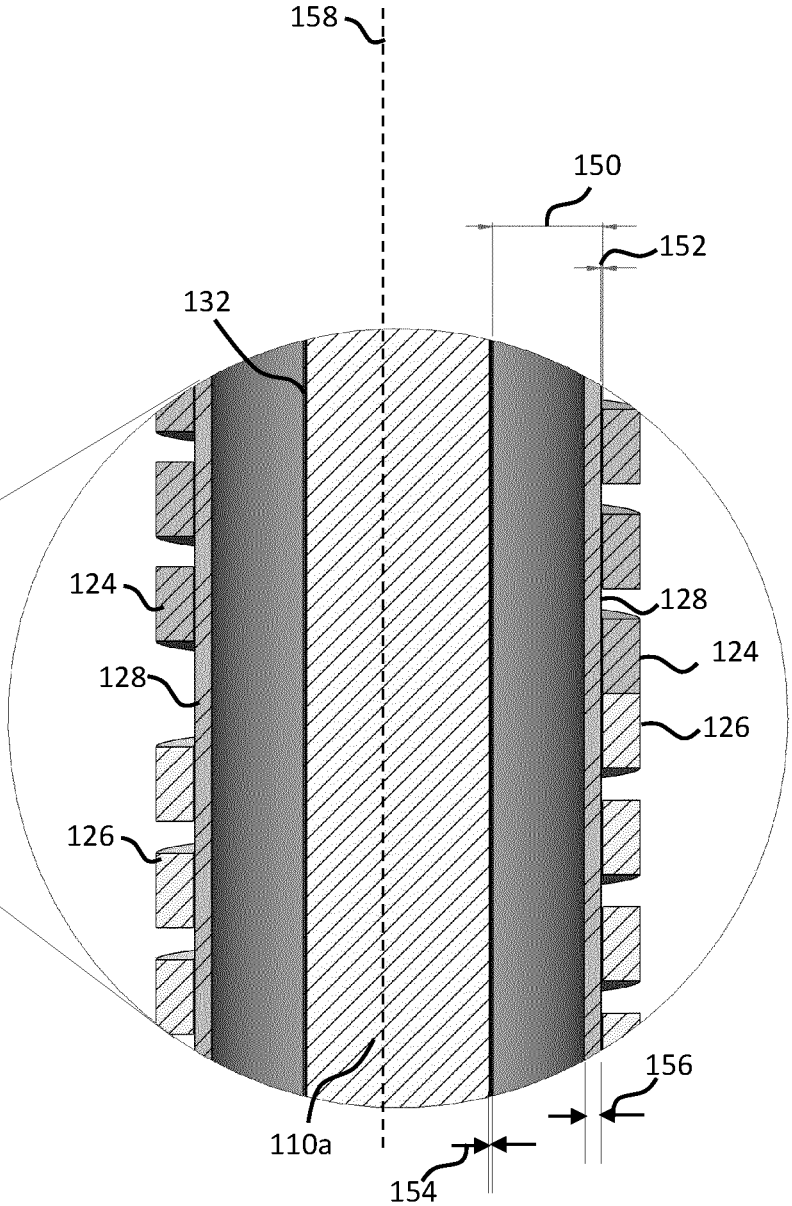
FIG. 5B shows a close-up view of a portion of the heating assembly of FIG. 5A.

FIG. 5A depicts a cross section of a portion of the device 100 of FIG. 1. FIG. 5B depicts a close-up of a region of FIG. 5A. FIGS. 5A and 5B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 5B shows that the outer surface of the susceptor 132 is spaced apart from the inner surface of the inductor coils 124, 126 by a distance 150, measured in a direction perpendicular to a longitudinal axis 158 of the susceptor 132. In one example, the distance 150 is about 3 mm to 4 mm, about 3-3.5 mm, or about 3.25 mm.

FIG. 5B further shows that the outer surface of the insulating member 128 is spaced apart from the inner surface of the inductor coils 124, 126 by a distance 152, measured in a direction perpendicular to a longitudinal axis 158 of the susceptor 132. In one example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40-45 mm, or about 44.5 mm.

In one example, the insulating member 128 has a wall thickness 156 of about 0.25 mm to 2 mm, 0.25 to 1 mm, or about 0.5 mm.

Figure 6:
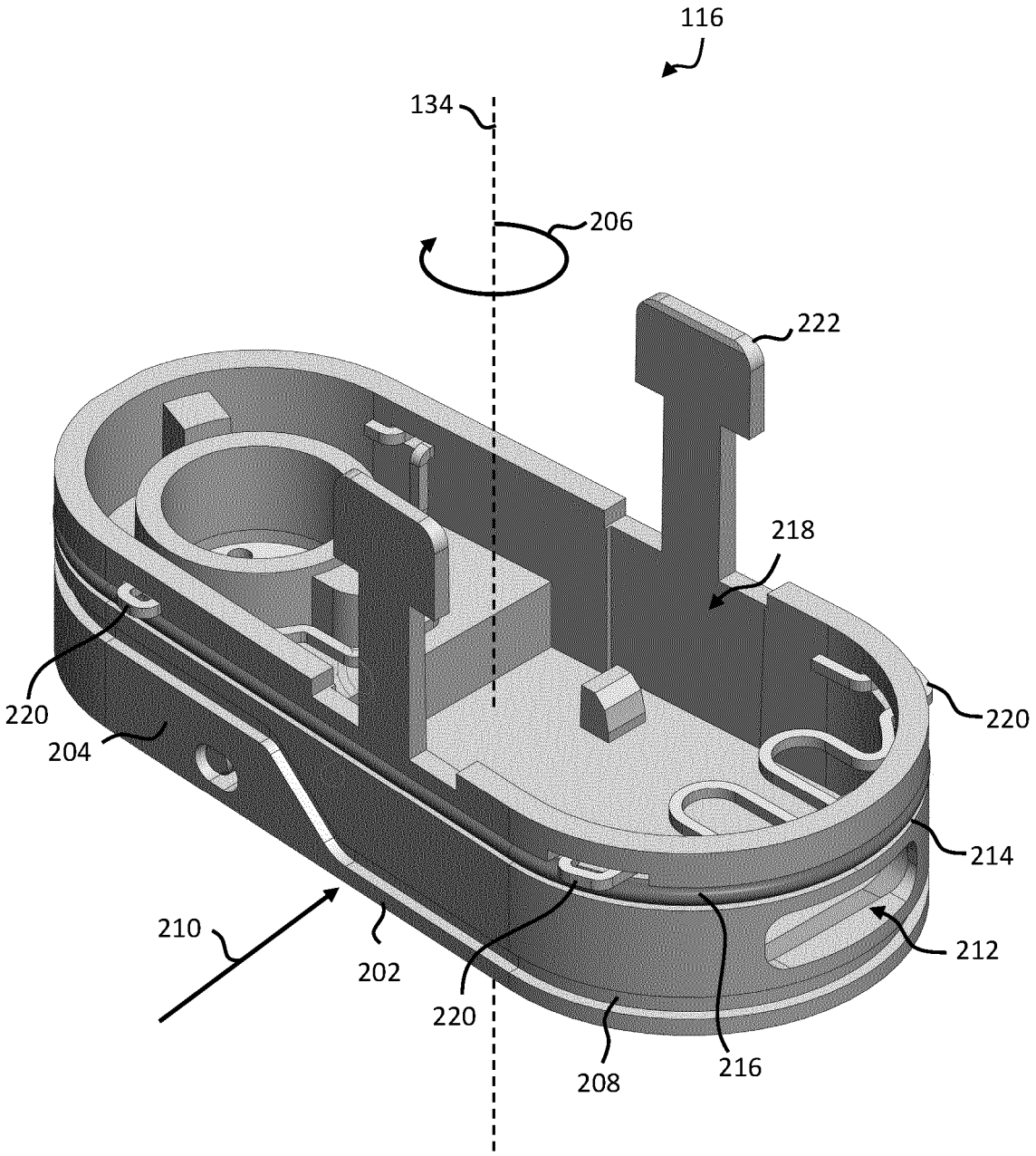
FIG. 6 shows a perspective view of an end member for an aerosol provision device.

FIG. 6 depicts the end member 116 and its arrangement relative to the longitudinal axis 134 of the device 100. As mentioned briefly, the end member 116 is arranged towards one end of the device 100 and is at least partially surrounded by the outer cover 102 (not shown in FIG. 6).

The end member 116 comprises a bottom/lower surface 202 (which forms part of an end surface of the device 100) and at least one side surface 204. In this example, the bottom surface 202 is arranged generally perpendicular to the axis 134. However, the bottom surface 202 may be arranged at other angles with respect to the axis 134. The end member in this example comprises a continuous side surface 204 which extends around the axis 134 in an azimuthal direction (indicated by arrow 206). In other examples, the end member may comprise two or more side surfaces which together extend at least partially around the axis 134. The outer cover 102 may at least partially surround and generally abut the side surface 204 once it is attached to the device 100. A lower edge of the outer cover 102 may lie flush with the bottom surface 202, and so also form part of the end surface of the device 100.

The end member 116 comprises a recess 208 positioned away from the bottom surface 202 in a direction parallel to the axis 134. The recess 208 is formed along the side surface 204 and extends fully around the end member 116 in the azimuthal direction 206 to form a continuous recess.

As mentioned above, the recess 208 acts to prevent/reduce water from flowing further into the device. For example, water may enter a small gap between the side surface 202 and the outer cover 102, and flow along the side surface 204 in a direction generally parallel to the axis 102. This flow of water may be due, at least partially, to capillary action. As the water reaches the recess 208, the flow of water is interrupted because the greater gap between surfaces makes the capillary action weaker. The recess 208 therefore acts as a barrier to stop the capillary flow of water. The water is therefore less likely to flow beyond the position of the recess 208. Components of the device which are positioned beyond the recess 208 are less likely to come into contact with the water.

The recess 208 has a depth dimension, which is measured in a direction perpendicular to the axis 134 (i.e., in the direction indicated by arrow 210). The recess also has a width dimension, which is measured in a direction parallel to the axis 134. In this example, the width dimension is 0.9 mm, and the depth dimension is 0.5 mm. A recess with these dimensions has been found to be suitable to reduce the ingress of water.

The end member 116 may further house one or more electrical components, such as a socket/port 114. For example, the end member 116 may define a cavity/receptacle 218, within which components may be positioned. As shown most clearly in FIGS. 3 and 4, the socket 114 can be arranged within the receptacle 218. The socket 114 in this example is a female USB charging port. Accordingly, to provide access to the socket 114, a through hole 212 may be formed in the side surface 204 of the end member 116. The socket 114 may be arranged inside the receptacle 118 adjacent to the through hole 212. As shown in FIG. 6, the socket 114 (and the through hole 212) are positioned further away from end surface of the device 100 than the recess 208. The recess 208 therefore reduces/stops water from contacting the socket 116.

The end member 116 may further comprise a second recess 214 within which a resilient member 216, such as an O-ring, can be received. In this example the second recess 214 extends around the end member 116 in the azimuthal direction 206 and is perpendicular to the axis 134. In other examples however, the second recess 214 may be arranged at angles other than 90 degrees to the axis 134. The second recess 214 is provided to hold the resilient member 216 in place. The resilient member 216 may abut the inner surface of the outer cover 102 to provide a seal. The resilient member 216 therefore acts as a second means of protection against water ingress should the water travel beyond the first recess 208. Accordingly, the second recess 214 may be positioned further away from the end surface than the first recess 208.

Although the second recess 214 is shown positioned further away from the end surface than the through hole 212 (and the socket 114), the second recess 214 may be positioned closer to the end surface than the through hole 212 (and the socket 114) in some examples.

The end member 116 may further comprise one or more attachment components 220 which are configured to engage and hold the outer cover 102 in place. In this example, the attachment components 220 protrude outwards from the side surface 204 and are received within corresponding recesses formed on the inner surface of the outer cover 102. It will be appreciated that other types of attachment components may be used. The attachment components 220 protrude through holes formed in the end member 116. The attachment components 220 are therefore generally located within the receptacle 218 and extend through the side surface 204. This can help reduce the size of the device 100 because the attachment component is primarily located within the receptacle 218 of the end member 116.

In this example the attachment components 220 are all positioned further away from the end surface than the first and second recesses 208, 214. This minimises the likelihood of the attachment components 220 coming into contact with water. In other examples, some, or all of the attachment components 220 may be positioned between the first recess 208 and the second recess 214.

The end member 116 may further comprise one or more connection members 222 which engage with the central support 120 (shown most clearly in FIG. 1). Other means of connecting the end member 116 to the central support 120 may be used.

Figure 7:
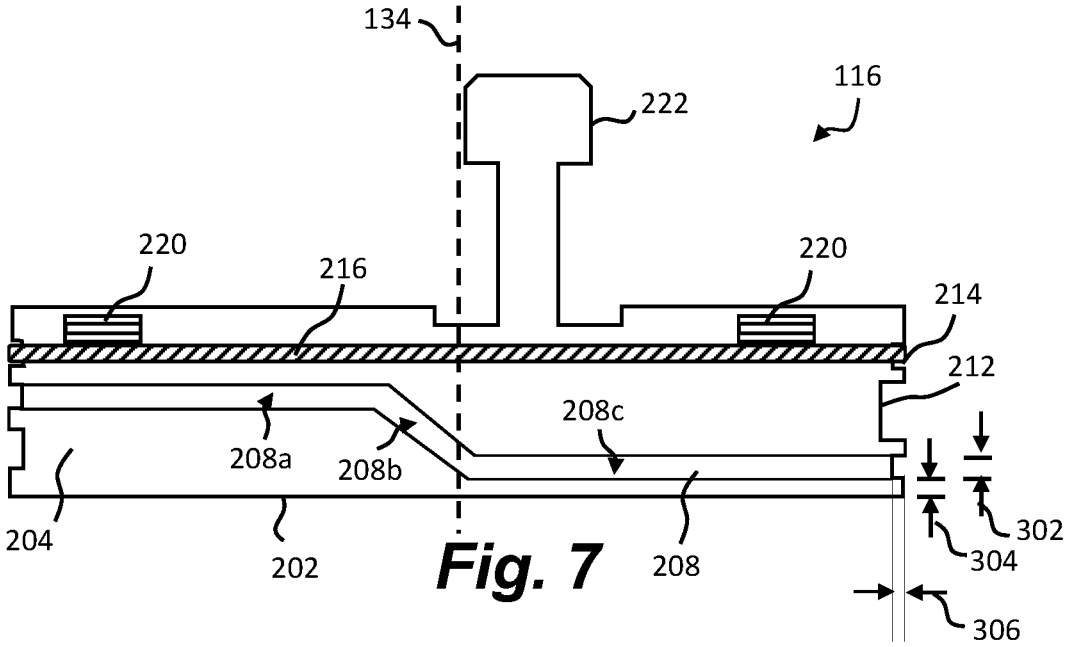
FIG. 7 shows a diagrammatic representation of a front view of the end member of FIG. 6.

FIG. 7 is a diagrammatic representation of the end member 116 of FIG. 6 as viewed in the direction of arrow 210.

In this example, the recess 208 comprises at least a first portion 208*a*, a second portion 208*b*, and a third portion 208*c*. The first portion 208*a* and the third portion 208*c* extend around the end member 116 in a direction which is substantially perpendicular to the axis 134 of the device 100. The second portion 208*b* extends around the end member 116 in a direction that is angled with respect to the first and third portions 208*c*.

In this example, the third portion 208*c* and part of the second portion 208*b* of the recess 208 is positioned between the electrical component 114 and the end surface. However, this still provides adequate protection from water ingress because water cannot easily cross the recess 208 using capillary action and the electrical component 114 is located on the other side of the recess 208 from the end surface.

The recess 208 has a depth dimension 306, which is measured inwardly from the side surface 204 in a direction perpendicular to the axis 134. The recess 208 also has a width dimension 302, which is measured in a direction parallel to the axis 134. In this example the width of the recess 208 is substantially constant along the recess 208, however, in other examples the width of the recess 208 may vary at different points around the recess. For example, the width may need to be wider at places where water ingress is more likely and/or where the effects of capillary flow are more pronounced. Similarly, the depth 306 of the recess 208 may vary at different points around the recess 208.

FIG. 7 also depicts the recess 208 being positioned away from the end surface of the device 100 by a distance 304. Because the distance varies at different points around the recess 208, the distance 304 is the distance from the end surface to a portion of the recess arranged closest to the end surface. In this example, the third portion 208*c* is positioned away from the end surface by a distance 304 of about 0.8 mm.

Figure 8:
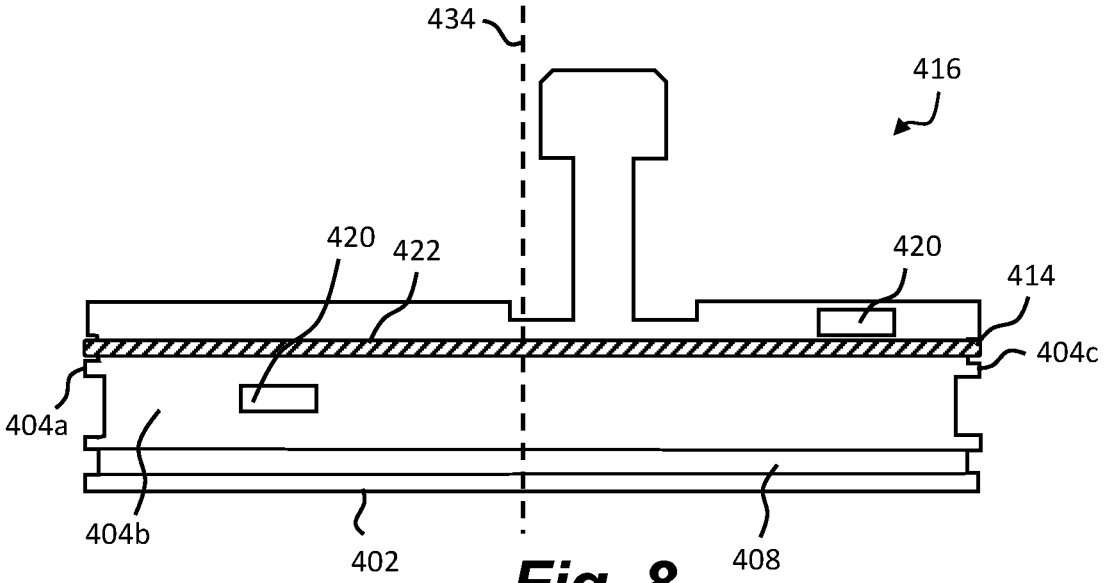
FIG. 8 shows a diagrammatic representation of a front view of another end member.

FIG. 8 is a diagrammatic representation of another end member 416. As with the example depicted in FIGS. 6 and 7, the end member 416 comprises a bottom/lower surface 402 (which forms part of an end surface of the device) and at least one side surface. In this example however, the end member 416 has a rectangular footprint, and therefore comprises four side surfaces, including a first side surface 404*a*, a second side surface 404*b*, a third side surface 404*c* and a fourth side surface (hidden from view).

The end member 416 comprises a recess 408 that extends fully around the end member 416 to form a continuous recess. Unlike the example in FIGS. 6 and 7, the recess 408 in this example extends around the end member 416 in a direction which is substantially perpendicular to the longitudinal axis 434 of the device for its entire length.

The end member 416 further comprises a second recess 414 within which a resilient member 422, such as an O-ring, is received.

The end member 416 further comprises one or more attachment components 420 which are configured to engage and hold an outer cover in place. In this example, the attachment components 420 are magnets. One attachment component 420 is positioned between the first recess 408 and the second recess 414 and another attachment component 420 is positioned further away from the end surface than the first and second recesses 408, 414. Other arrangements are possible.

Figure 9:
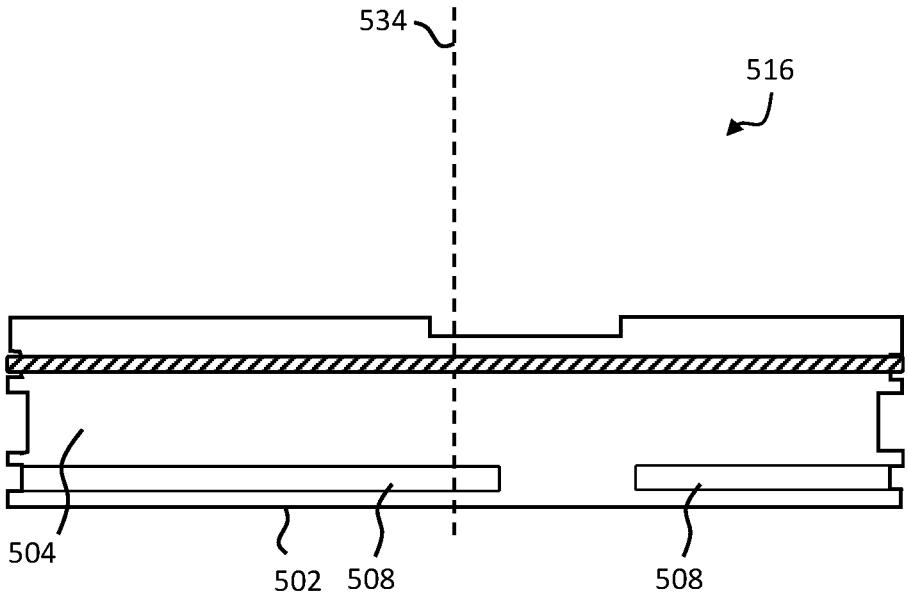
FIG. 9 shows a diagrammatic representation of a front view of another end member.

FIG. 9 is a diagrammatic representation of another end member 516. As with the examples depicted in FIGS. 6 and 7, the end member 416 comprises a bottom/lower surface 502 (which forms part of an end surface of the device) and at least one side surface 504. In this example, the end member 516 does not comprise any connection members which engage with a central support. Other means of connecting the end member 516 to the device may be used.

For example, components in the device may be attached/adhered to the end member 516. The end member 516 may comprise any of the features described in the examples of FIGS. 6, 7 and 8. However, unlike the examples of FIGS. 6, 7 and 8, the end member 516 comprises a recess 508 that does not fully extend around the end member 516. Instead, the recess 508 is non-continuous. In another example (not depicted), the recess may be non-continuous, but may extend fully around the end member to form a helical/spiral recess. In another example at least two separate recesses may each extend partially around the end member with the recesses partially overlapping in the direction perpendicular to the axis but offset along the longitudinal axis, such as forming an interdigitated pattern.

Figure 10:
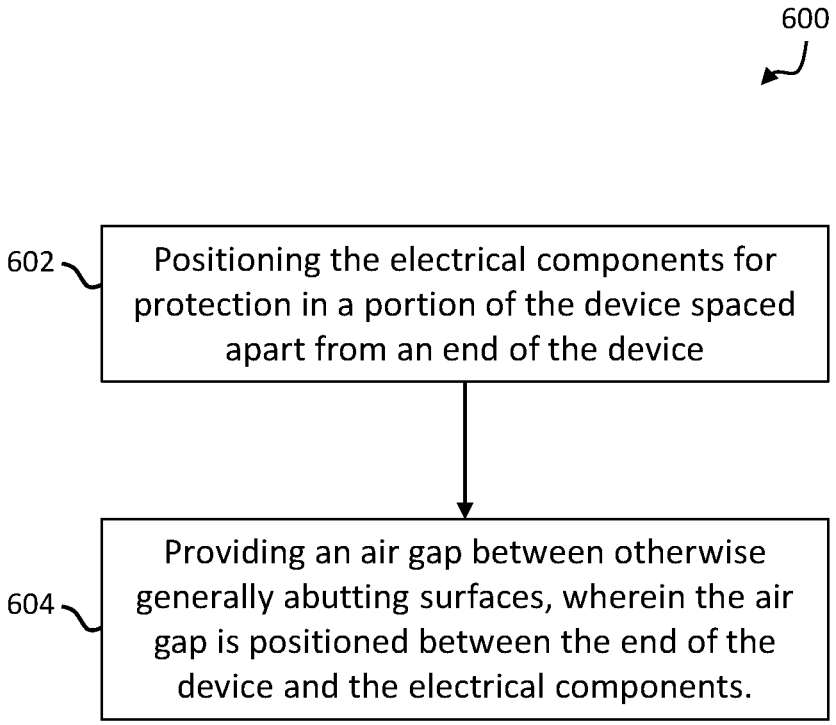
FIG. 10 shows a flow diagram of a method for protecting electrical components of an aerosol provision device from water ingress.

FIG. 10 depicts a flow diagram for a method 600 for protecting electrical components of an aerosol provision device from water ingress. The method comprises, in block 602, positioning the electrical components for protection in a portion of the device spaced apart from an end of the device. The method further comprises, in block 604, providing an air gap between otherwise generally abutting surfaces, wherein the air gap is positioned between the end of the device and the electrical components, the air gap preventing flow of water by capillary action from the end of the device to the electrical components.

The above embodiments are to be understood as illustrative examples. Further embodiments of the disclosure are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the disclosure.

The invention claimed is:

1. An aerosol provision device having an axis and comprising:

a power source; and an end member, at a first end, at least partially surrounded by an outer cover, the end member and the outer cover together defining an end surface of the aerosol provision device, wherein the end member defines a recess which is positioned away from the end surface in the direction of the axis and is covered by the outer cover, the recess configured to interrupt capillary flow of water.

2. The aerosol provision device of claim 1, wherein the recess extends fully around the axis to provide a continuous recess.

3. The aerosol provision device of claim 1, wherein the device comprises an electrical component located on the other side of the recess from the end surface.

4. The aerosol provision device of claim 3, wherein the electrical component is a socket and the end member delimits a through hole for access to the socket.

5. The aerosol provision device of claim 1, wherein the end member comprises a second recess extending around the axis, and the device further comprises a resilient member arranged in the second recess.

6. The aerosol provision device of claim 5, wherein the second recess is arranged further away from the end surface than the recess.

7. The aerosol provision device of claim 1, wherein the end member comprises an attachment component arranged further away from the end surface than the recess, wherein the attachment component engages the outer cover.

8. The aerosol provision device of claim 1, wherein the recess has a depth dimension of greater than about 0.5 mm.

9. The aerosol provision device of claim 1, wherein the recess has a depth dimension of less than about 4 mm.

10. The aerosol provision device of claim 1, wherein the recess has a width dimension of greater than about 0.5 mm.

11. The aerosol provision device of claim 1, wherein the recess has a width dimension of less than about 10 mm.

12. The aerosol provision device of claim 1, wherein at least a portion of the recess is positioned away from the end surface by a distance of about 1 mm to about 15 mm.

13. The aerosol provision device of claim 1, further comprising at least one inductor coil configured to generate a varying magnetic field for heating a susceptor.

14. An aerosol provision system, comprising:

an aerosol provision device according to claim 1; and an article comprising aerosol generating material.

15. A method for protecting electrical components and a power source of an aerosol provision device from water ingress, the method comprising:

positioning the electrical components and the power source for protection in a portion of the device spaced apart from an end of the device; and providing an air gap between otherwise generally abutting surfaces using a recess, wherein the air gap is positioned between the end of the device and the electrical components, the air gap preventing flow of water by capillary action from the end of the device to the electrical components.

16. The method of claim 15, wherein providing an air gap comprises providing an air gap greater than about 0.5 mm between the otherwise generally abutting surfaces.

* * * * *